US007914266B2

(12) United States Patent
Kerr et al.

(10) Patent No.: US 7,914,266 B2
(45) Date of Patent: Mar. 29, 2011

(54) SUBMERSIBLE PUMPING SYSTEM AND METHOD FOR BOOSTING SUBSEA PRODUCTION FLOW

(75) Inventors: John A. Kerr, Sugar Land, TX (US); Michael Birch, Sugar Land, TX (US); Joseph C. Scranton, Missouri City, TX (US); Tauna Leonardi, Pearland, TX (US); Randall S. Vessels, Crosby, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1119 days.

(21) Appl. No.: 10/907,114

(22) Filed: Mar. 21, 2005

(65) Prior Publication Data

US 2005/0220645 A1 Oct. 6, 2005

Related U.S. Application Data

(60) Provisional application No. 60/521,319, filed on Mar. 31, 2004.

(51) Int. Cl.
*E21B 7/12* (2006.01)
*E21B 7/124* (2006.01)

(52) U.S. Cl. ..... 417/410.1; 166/105; 166/357; 166/366

(58) Field of Classification Search ..... 417/410.1; 166/52, 245, 352, 366, 369, 335, 357, 370
See application file for complete search history.

(56) References Cited

U.S. PATENT DOCUMENTS

| | | | | |
|---|---|---|---|---|
| 4,126,406 | A * | 11/1978 | Traylor et al. | 417/373 |
| 4,669,555 | A * | 6/1987 | Petree | 175/97 |
| 4,982,794 | A * | 1/1991 | Houot | 166/357 |
| 5,979,559 | A * | 11/1999 | Kennedy | 166/369 |
| 6,046,521 | A * | 4/2000 | Heinig | 310/87 |
| 6,241,486 | B1 * | 6/2001 | Sloteman | 417/370 |
| 6,457,529 | B2 * | 10/2002 | Calder et al. | 166/368 |
| 6,640,900 | B2 * | 11/2003 | Smith | 166/336 |
| 6,651,745 | B1 * | 11/2003 | Lush et al. | 166/357 |
| 6,666,269 | B1 * | 12/2003 | Bangash et al. | 166/310 |
| 6,688,392 | B2 * | 2/2004 | Shaw | 166/366 |
| 7,188,669 | B2 * | 3/2007 | Bullock et al. | 166/105 |
| 7,249,634 | B2 * | 7/2007 | de Albuquerque Lima Goncalves et al. | 166/335 |
| 2003/0010500 | A1 * | 1/2003 | Smith | 166/336 |
| 2003/0106712 | A1 * | 6/2003 | Bourgoyne et al. | 175/5 |
| 2003/0132003 | A1 | 7/2003 | Arauz et al. | |
| 2003/0217848 | A1 * | 11/2003 | Shaw | 166/366 |
| 2005/0016735 | A1 * | 1/2005 | Ireland et al. | 166/352 |

* cited by examiner

*Primary Examiner* — Devon C Kramer
*Assistant Examiner* — Patrick Hamo
(74) *Attorney, Agent, or Firm* — Trop, Pruner & Hu, P.C.; Kevin B. McGoff; Rodney V. Warfford

(57) ABSTRACT

A booster pumping system is disclosed for producing hydrocarbons from a subsea production well. The booster pumping system includes: (1) a submersible pump hydraulically connected to the production well to provide energy to the hydrocarbon flow and boost production to another destination such as a subsea production facility or the surface via a riser; (2) an inlet conduit to receive the flow from the production well and isolate the flow from the dummy wellbore and direct the flow to the intake of the pump; and (3) a motor exposed to the dummy wellbore to drive the pump. The dummy wellbore may be flooded or circulated with seawater to cool the motor.

16 Claims, 3 Drawing Sheets

SUBMERSIBLE PUMPING SYSTEM AND METHOD FOR BOOSTING SUBSEA PRODUCTION FLOW

CROSS-REFERENCE TO RELATED APPLICATIONS

This claims the benefit under 35 U.S.C. §119(e) of U.S. Provisional Patent Application Ser. No. 60/521,319, entitled, "ELECTRIC SUBMERSIBLE PUMPING SYSTEM AND METHOD FOR BOOSTING SUBSEA PRODUCTION FLOW," filed on Mar. 31, 2004.

TECHNICAL FIELD

The present invention relates generally to a system for the boosting of hydrocarbons from a subsea production well, and more particularly to a system for producing hydrocarbons from a subsea production well with a submersible pump connected to the production well and deployed in a dummy well.

BACKGROUND

Subsea flow boosting pumps are generally used to deliver production fluid from subsea wells to remote storage or processing facilities. Such pumps may be submersible pumps installed in the production well (e.g., electrical submersible pumps or ESPs) or pumps located external the production well (e.g., seabed booster pumps). U.S. Pat. No. 6,688,392 to Shaw, which is incorporated herein by reference, describes a system for flow pressure boosting of hydrocarbon fluids in a subsea environment. Shaw describes a hydrocarbon flow boosting system including: a producing well for producing hydrocarbon fluids, a cased dummy well hydraulically connected to the producing well for receiving hydrocarbon fluids, and a pump and motor disposed in a liner in the dummy well for taking suction flow from the dummy well and boosting the flow energy of the discharge flow of hydrocarbon fluids. Particularly, the flow boosting system of Shaw may be operated by flooding the annulus of the cased dummy well with hydrocarbon fluids and pumping the fluids upward out of the annulus via the liner to a subsea processing station (as shown in FIG. 1 of Shaw). The motor of the pump in Shaw is thus surrounded by hydrocarbon fluids and may not be accessible for cooling facilities.

Accordingly, there exists a need for a flow boosting pump system whereby the pump motor is isolated from the production fluid such that motor cooling facilities may be employed.

SUMMARY

In general, according to one embodiment, the present invention provides a system for boosting subsea production fluid flow via one or more submersible pumping systems deployed in a dummy well and a conduit for containing the production fluid and isolating the production fluid from the wellbore of the dummy well. According to some embodiments, each submersible pumping system includes a pump and a motor deployed in a dummy well, where seawater (or other cooling agent) is circulated through the dummy well to cool the motor. According to other embodiments, an underwater vehicle (e.g., a remote operating vehicle or autonomous underwater vehicle) is provided for accessing and controlling pump operations.

Other or alternative embodiments of the present invention will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DESCRIPTION OF EMBODIMENTS OF THE PRESENT INVENTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In general, an embodiment of the present invention includes a system for producing hydrocarbons from a subsea production well with at least one submersible pumping system hydraulically connected to the production well and deployed in a dummy well. The pumps used in the present invention generally refer to electric submersible pumps or ESPs, however, other types of pumps may be used including, but not limited to piston pumps and positive displacement pumps.

Figure 1:
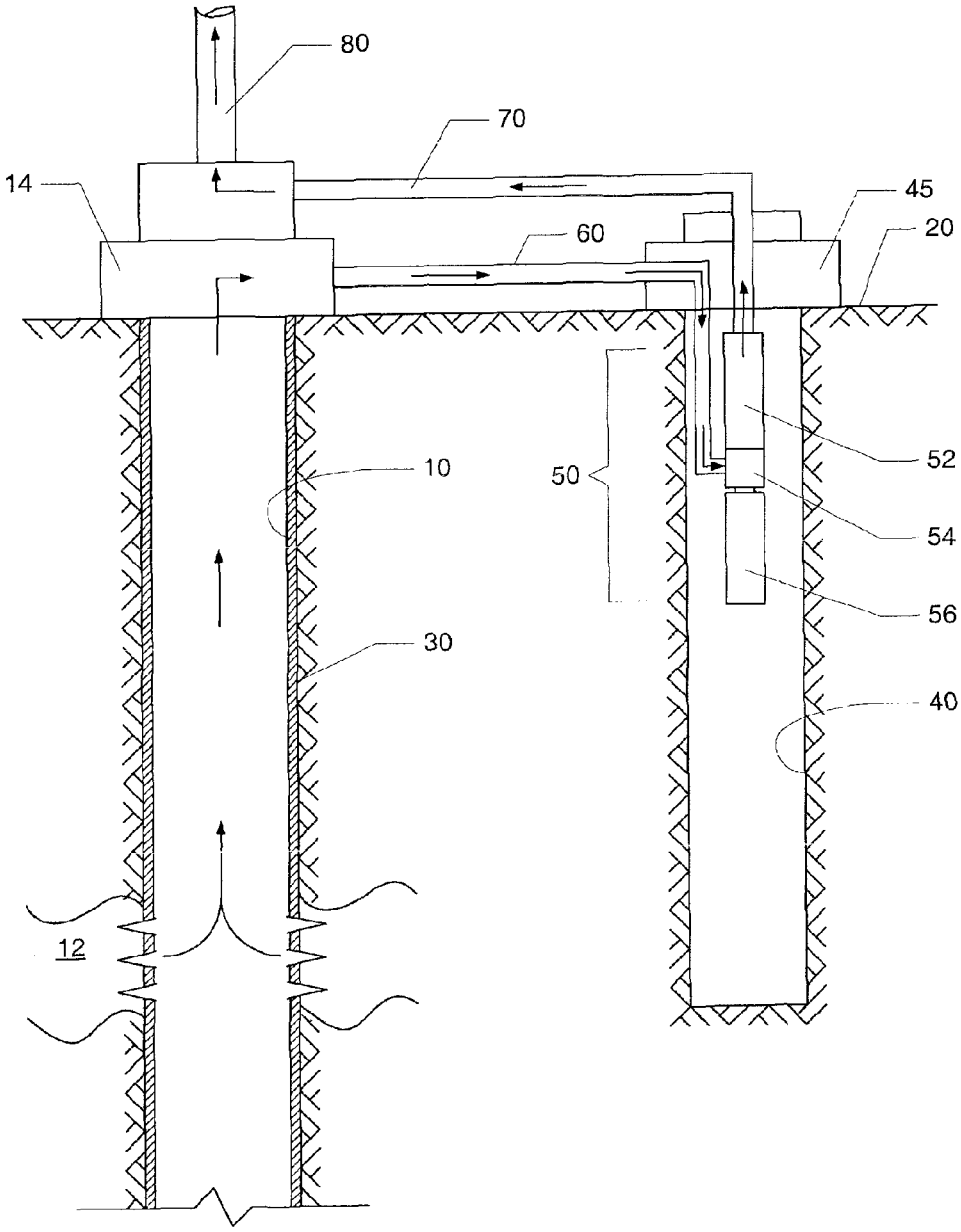
FIG. 1 illustrates a profile view of an embodiment of a booster pumping system deployed in a dummy well in accordance with the present invention for use with boosting flow in a production well.

With respect to FIG. 1, more particularly, one embodiment of the present invention includes a production well 10 having one or more hydrocarbon bearing formations 12 and a casing 30 intersecting the formation and establishing hydraulic communication between the formation and the seabed 20. The production well 10 further includes a wellhead 14 for sealing the well 10. A non-producing hole or "dummy well" 40 is provided proximate the production well 10. The proximity of the dummy well 40 to the production well 10 is relative to the scale of a vast sea, ocean, or other body of water and is determined based on operating conditions (e.g., the pump should be able to overcome pressure losses due to friction and well depth). A pumping system 50 is deployed in the dummy well 40 and is hydraulically connected to the production well 10 by an inlet pipe 60 and an outlet pipe 70. The pumping system 50 includes a submersible pump 52 having an intake 54, and a motor 56 coupled to the pump (mechanically, magnetically, or otherwise) to drive the pump. The inlet pipe 60 is connected to the intake 54 and isolates incoming production fluid from the wellbore of the dummy well 40. A production pipe 80 is connected to the wellhead 14 of the production well 10 to transport the boosted production fluid from the well. The production pipe 80 may include a riser conduit to deliver the boosted production fluid to the surface or else an intermediate conduit to transport the production fluid to a subsea facility (e.g., for storage, separation, or other). Alternatively, the outlet pipe 70 may be a production pipe for delivering the production fluid to other destinations besides back to the wellhead 14 of the production well.

Figure 2:
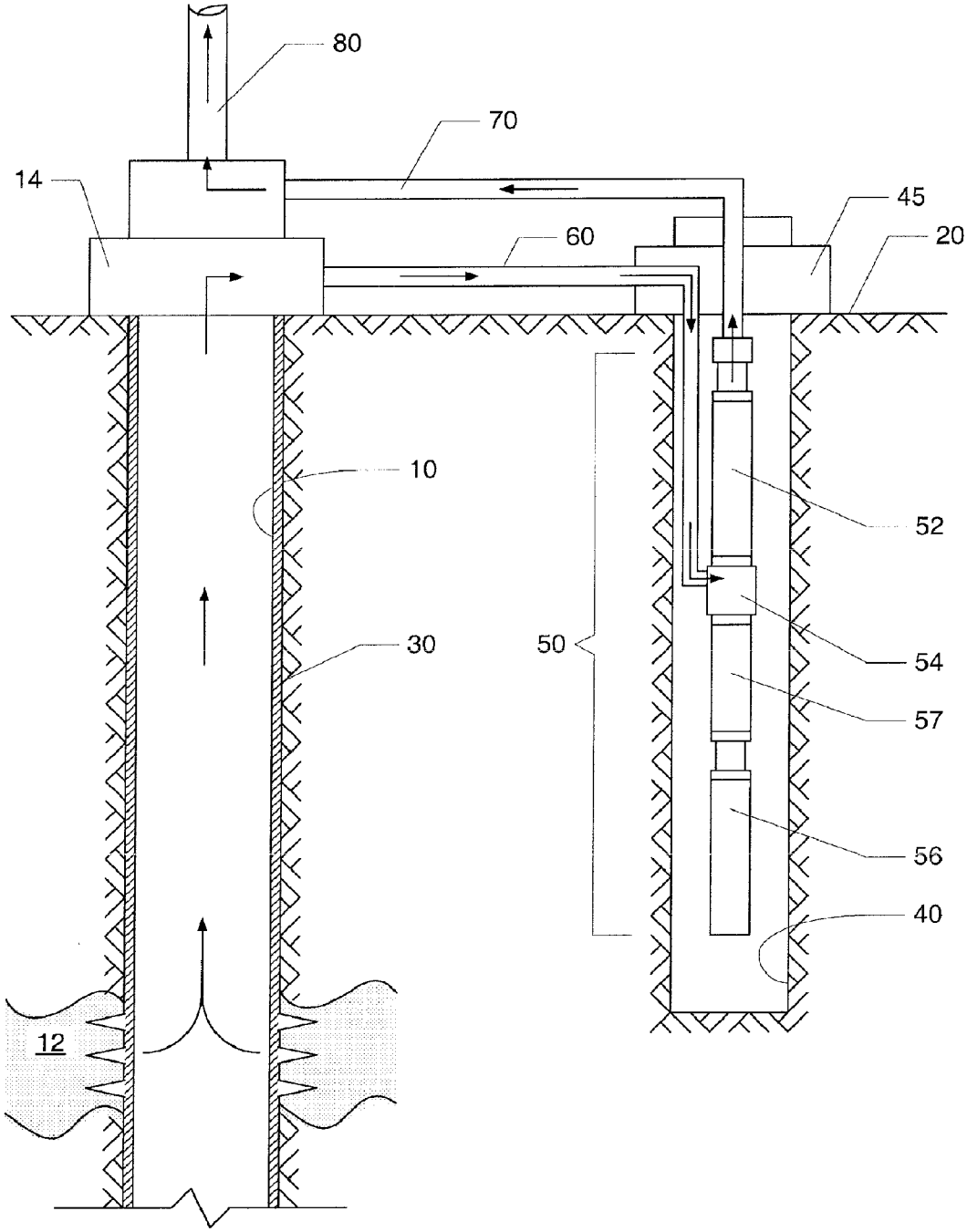
FIG. 2 illustrates a profile view of an embodiment of a production well, a dummy well, and a booster pumping system of the present invention having pump, motor, and protector components deployed in the dummy well.

FIG. 2 illustrates another embodiment of the booster pumping system of the present invention. This embodiment of the booster pumping system 50 includes a protector 57 connected between the motor 56 and the pump 52. The protector 57, for example, may be any motor protector that is well known to those skilled in the art including, but not limited to, a labyrinth-type protector, elastomer bag, piston protector, bellows, and/or gas chamber or positive-pressure protector. The protector may provide the capability of compensating volume changes due to thermal expansion of the oil in the motor 56, isolating of the oil from the production fluid or other wellbore fluids or seawater in the dummy well 40, sealing the motor 56 from the production fluid in the pump 52, carrying the axial load of the pump 52 such as via thrust bearings in connection with the motor 56, and/or transmitting torque from the motor 56 to the pump 52. Moreover, the protector 57 may also house the thrust bearings.

With respect to both FIGS. 1 and 2, in operation, to boost the flow of the production well 10, a dummy well 40 may be drilled to house a booster pumping system 50. The booster pumping system 50 is installed in the dummy well 40 and suspended from a dummy wellhead 45. The motor 56 of the booster pumping system 50 is used to drive the pump 52 to draw production fluid from the production well 10 into the intake 54 of the pump via the inlet pipe 60. In the embodiment illustrated in FIG. 1, the motor 56 transmits the torque directly to the pump 52. In the embodiment illustrated in FIG. 2, the motor 56 transmits the torque to drive the pump 52 via the protector 57, which also may seal the motor from contact with the production fluid. The production fluid supplied to the pumping system 50 is isolated from the open dummy well 40 by the inlet pipe 60. The production fluid is then energized by the pump 52 to boost the flow back to the production wellhead 14 (or other destination) via the outlet pipe 70. The energized or boosted flow of the production fluid is then delivered from the production well 10 to another destination via the production pipe 80. In some embodiments, seawater may be circulated or otherwise delivered into or free to move into the dummy well 40 to engage the motor 56 for cooling effect.

Figure 3:
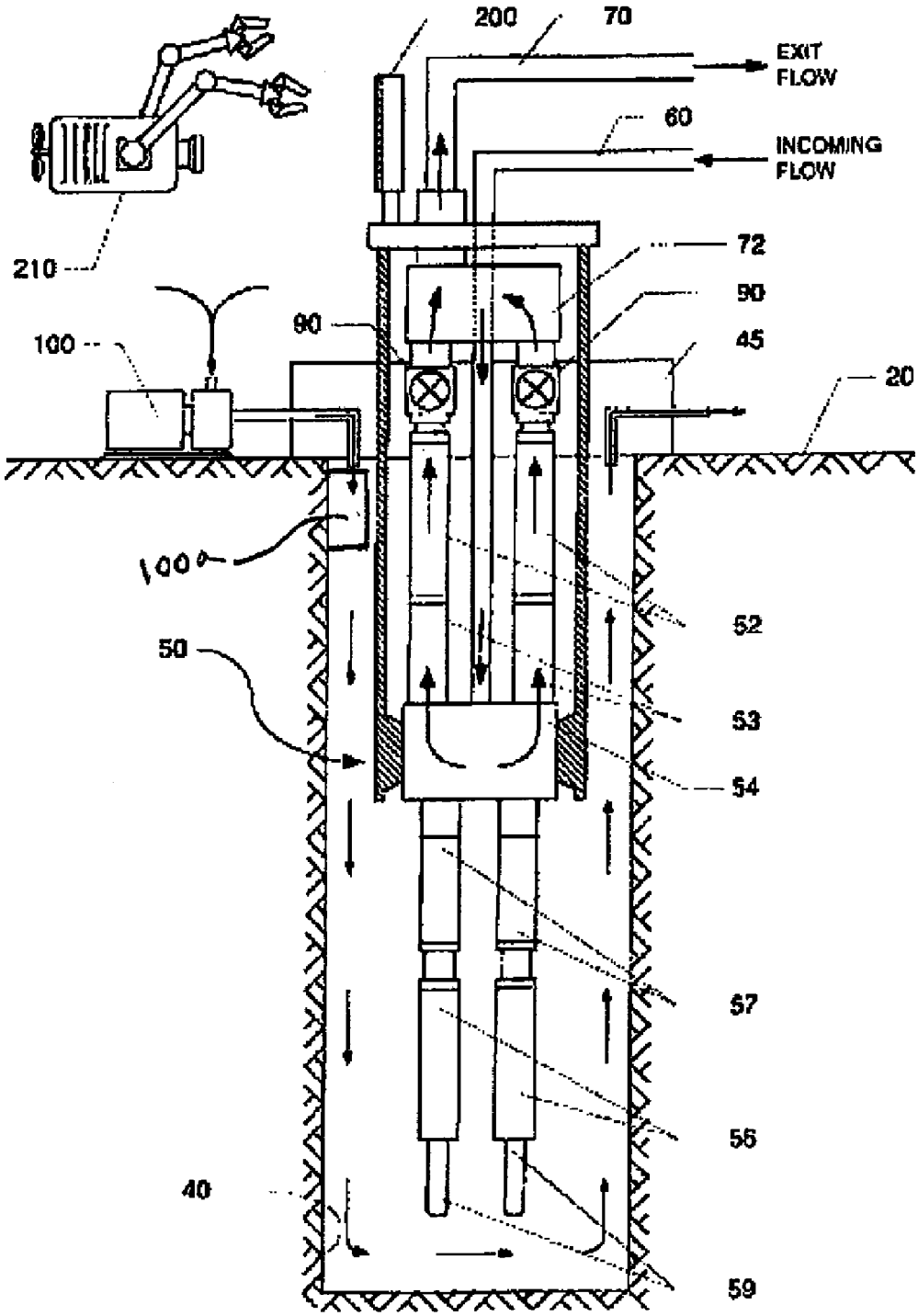
FIG. 3 illustrates an enlarged cross-sectional view of an embodiment of a booster pumping system of the present invention having pump, motor, and protector components deployed in a dummy well and operated by a remote operated vehicle.

FIG. 3 illustrates yet another embodiment of the pumping system 50 of the present invention for use in boosting the production fluid flow of a production well. This embodiment of the pumping system 50 includes a plurality of pumps 52. In alternative embodiments, the pumps 52 may be run simultaneous (in series or parallel) to increase the energy imparted to the production flow or as primary and secondary pumps to provide a redundant or back-up pump in the event that one of the pumps is shut down or otherwise becomes inoperable. Each pump 52 is driven by a motor 56. The pumps 52 may share an intake 54 or otherwise each pump may have a dedicated intake. In this embodiment, the intake 54 is an intake manifold for receiving an inlet flow and delivering a plurality of outlet flows (in this case two). While only two pumps are shown in FIG. 3, it is intended that other embodiments of the present invention include a booster pumping system comprising any number of pumps arranged either in series or parallel. The pumps 52 may be suspended from a dummy wellhead 45. An inlet conduit 60 takes incoming production fluid and directs such fluid to the intake 54 of the pumps 52. Once energy is imparted into the incoming production fluid to boost the flow by the pumps 52, the production fluid is directed away from the pumping system 50 to another destination via an outlet conduit 70 (e.g., back to the production well, to a subsea production facility, or to the surface via a riser). Moreover, the pumping system 50 may include an inline valve 90 installed between each pump 52 and the outlet conduit 70 to regulate the boosted production flow. In some embodiments having multiple pumps run in parallel 52, an outake manifold 72 is provided for combining the energized production flows for delivery to a destination via the outlet conduit 70.

With respect to FIG. 3, in some embodiments, the pumping system 50 may further include a gas handling device 53 connected between the pump 52 and the motor 56 to prevent production flow having a high gas-to-liquid ratio from causing the pump to lock or become otherwise inoperable. The gas handling device 53 may include impellers for mixing the gas and liquid content to reduce the formation of gas bubbles, which are known to cause "pump lock." One such gas handling device is described in U.S. Pat. No. 5,628,616, which is incorporate herein by reference.

Still with respect to FIG. 3, in some embodiments, the pumping system 50 may further include a monitoring tool 59 connected to each motor 56 for detecting the conditions of the pumping system 50 and/or the dummy wellbore environment. For example, the monitoring tool 59 may include a pressure sensor for detecting dummy wellbore pressure, a temperature gauge for detecting dummy wellbore temperature (e.g., the temperature of the seawater surrounding the motor), a flowmeter for monitoring flow of seawater circulation through the dummy well, a vibration monitor and so forth.

Yet still with respect to FIG. 3, in some embodiments, seawater may be circulated or otherwise delivered into or may be free to move into the dummy well 40 to engage the motor 56 for cooling effect. For example, the dummy well 40 may be flooded with seawater for cooling the motor 56 of the pumping system 50 deployed therein. Alternatively, the seawater may be circulated via a dedicated circulation pump 100 or circulated naturally due to temperature gradients via an opening in the dummy wellhead 45. In other embodiments, pipes or other conduits may be installed around the motor 56 for pumping cool fluids in and/or hot fluids out to aid in natural convection cooling of the motor. Furthermore, one or more circulation pumps 100*a* (e.g., jet pumps) may alternatively be arranged within the dummy well or otherwise attached to the bottom of the production fluid booster pumps to circulate seawater.

In some embodiments of the present invention, the pumping system 50 may be operated subsea by divers accessing a control station located proximate the dummy well on or near the seabed 20. At subsea depths not accessible by divers, as shown in FIG. 3, the pumping system 50 may include a control station 200 accessible by an underwater vehicle 210 such as a tethered remote operated vehicle (ROV) or an autonomous underwater vehicle (AUV). The underwater vehicle 210 includes devices for: (1) maneuvering in a subsea environment in order to approach the subsea control station 200, (2) manipulating the controls to operate the pumping system 50, and (3) communicating with the surface to transmit and receive data necessary to perform tasks and make reports. In some embodiments, the underwater vehicle 210 is an ROV tethered to a surface vessel or rig. In other embodiments, the underwater vehicle 210 is an AUV guided by a remote guidance signaling system sent by an operator at the surface or by automated programming. Moreover, an embodiment of the present invention may include a home station (not shown) for housing the underwater vehicle 210 in a subsea environment near or on the seabed 20. The home station may provide power to and communicate with the associated underwater vehicle that resides at the home station until control of the pumping system 50 is needed. Therefore, when such control is needed, the underwater vehicle 210 deploys from the home station to the control station 200 that is associated with the pumping system 50 of the dummy well 40 to be operated. The underwater vehicle 210 performs the commands at the control station 200 and subsequently returns to the home station. In some embodiments of the invention, the underwater vehicle 210 is self-guided and self-powered when traveling between the home station and the control station 200. Therefore, the underwater vehicle 210 does not have a tethered cable or wire connection to the home station or any other point when traveling along the seabed 20. In other embodiments, the underwater vehicle 210 may have a tethered connection to the home station. In some embodiments, the underwater vehicle 210 may receive power to recharge and maintain the charge on a battery when the underwater vehicle is docked to the home station. Furthermore, when docked to the home station, the underwater vehicle 210 also may communicate to an operator at the surface of the sea via a tethered cable between home station and equipment at the surface. The underwater vehicle 210 may also dock to a particular control station 200 to allow the underwater vehicle to communicate with the surface and receive power from the surface, as each dummy wellhead 45 may also be connected to receive power from and communicate with equipment at the surface. Such power may be used, among other things, to power to pumping system 50 in including the motors 56, the control valves 90, the monitors 59, and the circulation pump 100.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A system for producing a hydrocarbon fluid from a production well, comprising: a dummy well; a pump arranged in the dummy well and hydraulically connected to the production well via a conduit to deliver the hydrocarbon fluid to the pump, the hydrocarbon fluid being isolated from the dummy well by the conduit; and a motor arranged in the dummy well and operatively connected to the pump, the motor adapted to drive the pump, wherein the dummy well is filled with seawater during operation of the pump to reduce temperature of the motor.

2. The system of claim 1, further comprising: a circulation pump to circulate seawater into the dummy well.

3. The system of claim 1, further comprising: a motor protector connected between the pump and the motor.

4. The system of claim 1, further comprising: a gas handler connected between the pump and an intake.

5. The system of claim 1, further comprising: a monitoring device connected to the motor.

6. The system of claim 5, wherein the monitoring device is a pressure sensor adapted to detect pressure in the dummy wellbore.

7. The system of claim 5, wherein the monitoring device is a temperature gauge adapted to detect temperature in the dummy wellbore.

8. The system of claim 1, further comprising: a circulation pump located at a seabed proximate the dummy well, wherein seawater is circulated through the dummy wellbore by the circulation pump during operation of the pump to cool the motor.

9. The system of claim 1, further comprising: a circulation pump arranged in the dummy wellbore, wherein seawater is circulated through the dummy wellbore by the circulation pump during operation of the pump to cool the motor.

10. The system of claim 1, further comprising: a control station located at or above a seabed proximate the a wellhead, the control station adapted to operate the pump.

11. The system of claim 10, further comprising an underwater vehicle adapted to travel subsea to the control station and operate the pump.

12. The system of claim 1, further comprising: a second pump arranged in the dummy well, the second pump having a discharge; a second motor operatively connected to the second pump and arranged in the dummy well, the second motor adapted to drive the second pump; and one or more valves for regulating hydraulic communication between the discharge of each first and second pump and a production flow destination, wherein an intake provides hydraulic communication between the second pump and the conduit.

13. The system of claim 1, wherein the discharge of the pump is hydraulically connected to a production flow destination by a production pipe.

14. The system of claim 13, wherein the production flow destination is a subsea facility.

15. The system of claim 13, wherein the production flow destination is a surface vessel and the conduit is a riser.

16. A method for producing a hydrocarbon fluid from a subsea production well, comprising: deploying at least one pump in a dummy well; hydraulically connecting the at least one pump to the production well; coupling a motor to the at least one pump to drive the at least one pump; flooding the dummy well with seawater; imparting flow energy to the hydrocarbon fluid using the at least one pump while isolating the hydrocarbon fluid from the dummy well; and exposing the motor to seawater in the dummy well to cool the motor.

* * * * *